United States Patent [19]

Castello

[11] 4,040,275

[45] Aug. 9, 1977

[54] KNIT-IN POCKET AND METHOD

[76] Inventor: Leo J. Castello, 3702 Burnett Lane, Huntingdon Valley, Pa. 19006

[21] Appl. No.: 460,064

[22] Filed: Apr. 11, 1974

[51] Int. Cl.[2] ..... D04B 1/24

[52] U.S. Cl. ..... 66/64; 66/170; 66/196

[58] Field of Search ..... 66/196, 197, 170, 176, 66/171, 175, 64, 172 R

[56] References Cited

U.S. PATENT DOCUMENTS

| | | | |
|---|---|---|---|
| 212,580 | 2/1879 | Wechsler | 66/176 |
| 1,072,640 | 9/1913 | Nydegger | 66/171 |
| 1,572,434 | 2/1926 | Kaiser | 66/171 |
| 2,164,289 | 6/1939 | Holmes | 66/172 R |
| 2,314,618 | 3/1943 | Green | 66/172 R X |
| 2,763,144 | 9/1956 | Bristow | 66/172 R X |
| 3,107,510 | 10/1963 | Manger | 66/196 X |
| 3,602,914 | 9/1971 | Castello | 66/196 X |

FOREIGN PATENT DOCUMENTS

| | | | |
|---|---|---|---|
| 1,187,022 | 4/1970 | United Kingdom | 66/172 R |

OTHER PUBLICATIONS

*Knit-in Pockets,* in Knitting International, 81(971): p. 69, Nov. 1974.

*Primary Examiner*—Mervin Stein
*Assistant Examiner*—A. M. Falik
*Attorney, Agent, or Firm*—Weiser, Stapler & Spivak

[57] ABSTRACT

A method of knitting an integral pocket in a knitted garment which includes the steps of knitting the front and rear garment panels of single layer construction, knitting one or more integral pockets by knitting an enclosed tubular area which is completely closed on all sides, said tubular area including a portion of a knit panel, the said tubular pocket being knit to a pattern either conforming with or contrasting from the remainder of the knit panel. The top last course of the knit-in tubular pocket is easily opened by creating a long knitted loop on each end of the top corners of the pocket to permit pulling a thread or yarn from either corner to automatically open the tubular pocket.

6 Claims, 15 Drawing Figures

FIG. 1
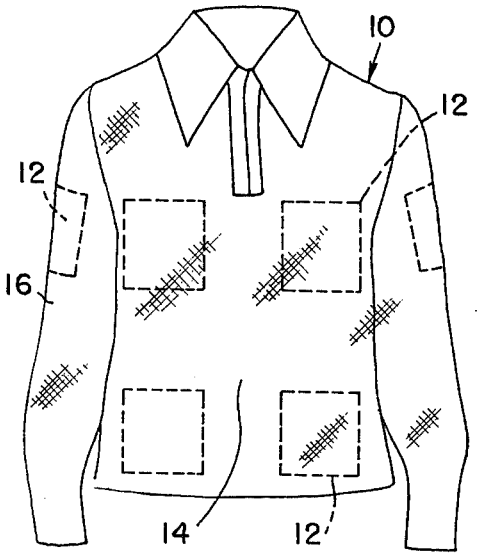
FIG. 5
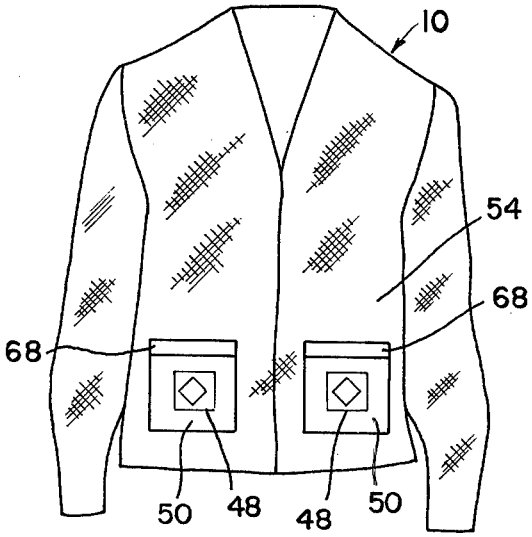
FIG. 2
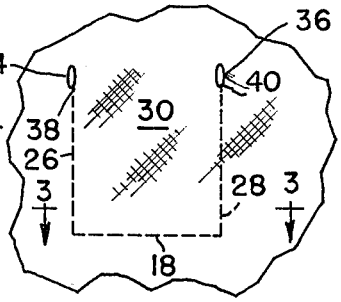
FIG. 3
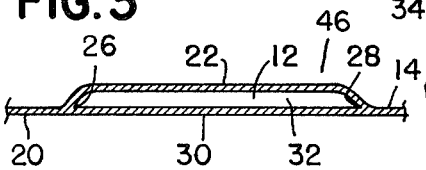
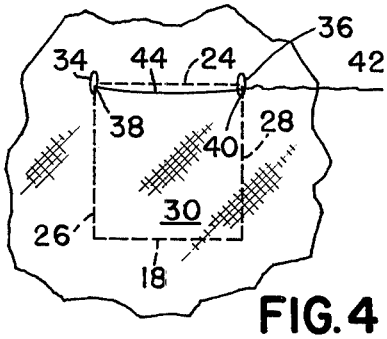
FIG. 4
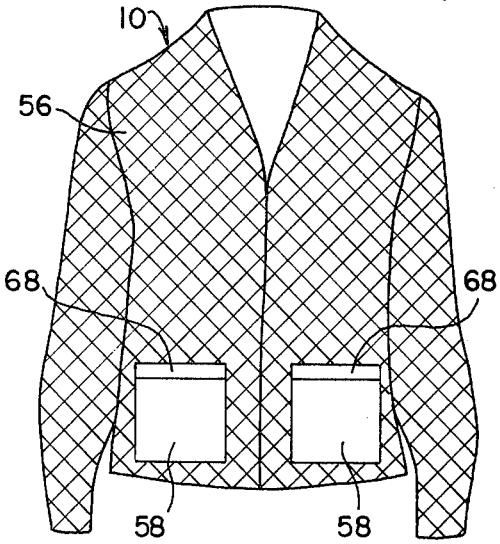
FIG. 6
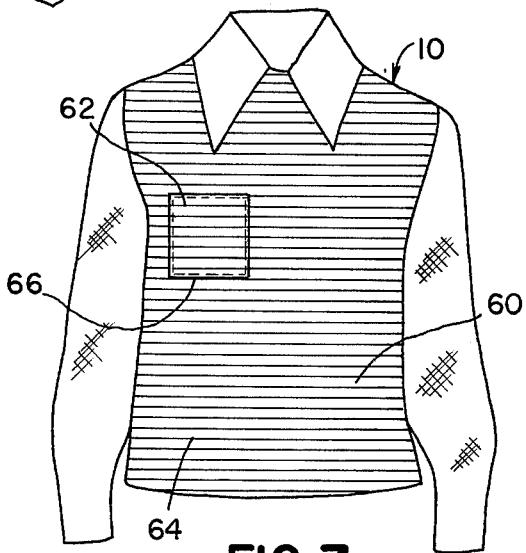
FIG. 7

KNIT-IN POCKET AND METHOD

BACKGROUND OF THE INVENTION

This invention relates generally to the method of fabricating knit sweaters, and more particularly, is directed to a method of fabricating a knit-in pocket directly in the sweater panel construction.

It has been the common practice by prior workers in the art to provide pockets in knit garments such as sweaters, shirts, vests, and dresses by fabricating a separate tubular pocket either of knit material or other material which is entirely separate from the garment construction itself. The garment is then split in a desired location to provide an opening therein and the separate pocket fabric is then affixed to the sweater or other garment at the opening by hand sewing wherein it is securely affixed in place, the said panel opening providing access to the pocket itself. When utilizing this method, the garment at the pocket construction is three layers thick comprising an outside layer consisting of the garment panel itself, and the two inner layers which define the pocket and which are formed of the tubular pocket where it is affixed to the garment. The remainder of the sweater or other construction is only one layer thick in all other sections. This variation in thickness or bulk detracts from the aesthetic effect of the garment and also results in considerable increase in fabrication costs in view of the additional hand operations required. Because of this, it was economically unadvisable to design a sweater having a plurality of pockets. Also, the prior art type of pocket is characterized in being supported by the garment only along the upper sewn edges thereof where they are actually connected to the upper and lower margins defining the opening in the garment panel which communicates with the interior of the pocket. After continued use, the marginal edges of the garment panel which define the opening into the pocket tend to gap and sag inasmuch as the sewn edges are the only portion of the knit panel which supports the pocket.

SUMMARY OF THE INVENTION

The present invention relates generally to the field of knitted garments, and more particularly, is directed to a method of knitting one or more pockets simultaneously with knitting the garment panels.

The present invention includes a novel method of fabricating knit garments with knit-in pockets wherein the pockets are each defined between a single thickness knit garment panel and a single thickness inner layer which is integrally connected to the outer panel along three sides thereof and which is knitted simultaneously with the outer garment panel to provide a tubular construction. In accordance with the present invention, the pocket construction may consist of a single knit chest pocket such as on a golf shirt or a pair of pockets such as are conventionally sewn on a cardigan type sweater near the bottom of the sweater. Optionally, by employing the method of the present invention, one or more chest pockets plus one or more bottom pockets can be quickly and inexpensively knit. Four, five, six or more pockets in one sweater can be automatically knitted if so desired in accordance with a pre-designed pattern and depending on the width and length of the sweater and the size of the pocket to be knit. Further, pockets constructed in accordance with the method of the present invention can be knit in the sleeves and one or more sleeve pockets can be readily formed. The present invention teaches a relatively simple method to provide a plurality of pockets which are knit automatically and without incurring the prohibitative costs of hand operations which were formerly attendant with pocket constructions provided by conventional methods.

The method of the present invention includes knitting a tubular fabric of the desired pocket size at each pocket location and then finishing the tops of the knitted pockets by providing a long, knitted loop on each end of the top corners of the pockets. The top coursewise thread is cut at the loops and is pulled at the top of the pocket in a manner similar to a draw thread. In this manner, the top part of the pocket is automatically separated to provide a top opening without the need to cut all of the loops of the top course by use of a scissors, knife or other sharp instrument. The use of the draw thread eliminates hand operations such as cutting and sewing at each pocket and results in great cost savings. The method of the present invention can be readily practiced on the type of conventional machine having Jacquard cards, drum wheels, electronic or other mechanical individual needle control systems such as TJI, Links and Links, Jumberca, Bentley, and other such similar type knitting machines.

By employing the method of the present invention, different style features can be easily and inexpensively created at the knitted pockets in accordance with any predetermined design. Two, three or more colors utilizing Jacquard patterns can be produced around the knit-in pocket. For example, a pattern or design either including or not including the knit-in pocket can be automatically knit in the garment fabric. Optionally, a complete solid colored sweater or shirt could be knit with a knit-in pocket of the same color or a float Jacquard design could be knit in the pocket alone and the surrounding portion of the sweater could be of a solid color. Various combinations of Jacquard designs can also be automatically knit to include the pocket in the general design or to exclude the pocket when so desired.

By employing the method of the present invention, any size pocket can be automatically and inexpensively knit in the sweater construction such as pockets varying in length or width from the size of a small coin pocket, to a cigarette or eye glass carrying pocket, to a large pouch pocket or any other size or design of pocket construction. The present method substantially eliminates hand operations when forming pockets and accordingly removes most of the cost problems which faced designers when considering utilizing the hand techniques which were inherent in the prior art method.

It is therefore an object of the present invention to provide an improved method for fabricating pockets in knitted garments. It is another object of the present invention to provide a novel method for fabricating knitted garments with knit-in pockets which completely eliminates the usual dangling type pocket or sewn in type of patch pocket.

It is further object of the present invention to provide a novel method for fabricating a knit garment with a knit-in pocket which can be automatically knit on conventional knitting machines without the need for additional costly hand operations.

It is a further object of the present invention to provide a method for fabricating a knit garment with a knit-in pocket which includes the capability of providing automatically knit garment designs which optionally can either include or exclude the pocket area.

It is a further object of the present invention to provide a novel method for fabricating a knit garment with a knit-in pocket that is automatic in operation, simple in design, and relatively low cost in production.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a front elevational view of a knit garment showing one or more knit-in pockets made in accordance with the method of the present invention.

FIG. 2 is an enlarged, elevational view of a portion of the garment of FIG. 1, showing one knit-in pocket prior to opening the top thereof.

FIG. 3 is a cross sectional view taken along Line 3—3 of FIG. 2, looking in the direction of the arrows.

FIG. 4 is a view similar to FIG. 2, showing the top of the knit-in pocket after opening the top seam.

FIG. 5 is a front elevational view of a knitted garment showing a knitted design in the pocket area only.

FIG. 6 is a front elevational view of a knit garment showing a design in the knit fabric and having no design in the pocket area.

FIG. 7 is a front elevational view of a knitted garment showing a design in the pocket area which conforms to the design of the remainder of the knitted garment.

DESCRIPTION OF THE PREFERRED EMBODIMENT OF THE INVENTION

Figure 8:
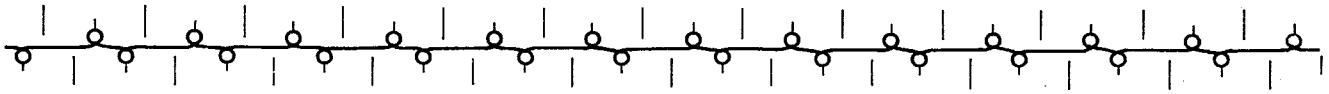
FIGS. 8–15 are sketches showing the method of knitting the knit-in pocket from the courses immediately below the pocket to immediately above the pocket.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a knit garment 10 which could be a sweater or knit shirt of conventional configuration. In accordance with the teachings of this invention, a knit-in pocket 12 can be knit simultaneously with the knitting of the garment front panel 14 or the sleeve panel 16. The knit-in pocket could be automatically produced on all knit items such as sweaters, shirts, vests, dresses, scarves and the like. The knit-in pocket of the present invention can be produced on automatic flat and circular bed knitting machines having Jacquard cards, drum wheels, electronic or other mechanical individual needle control systems such as a TJI, Links and Links, Jumberca, Bentley or other similar types of knitting machines. Single or multiple chest pockets can be knit and one or more bottom pockets could be provided if desired. Four, five, six or more pockets in one sweater could also be inexpensively knit depending on the width and length of the sweater, the size of the pocket and the final design as desired for the garment 10. One or more knit-in pockets 12 could similarly be knit in the sleeves by utilizing the method taught by the present invention.

Referring now to FIGS. 2, 3 and 4, I show a knit-in pocket 12 which is automatically knit in conjunction with a knit garment front panel 14. A selected group of high and low butt needles or high and low butt jacks (not shown) are arranged for producing a tubular knit-in pocket 12 automatically as the front panel 14 is knitted. In knitting the front panel 14, the knitting machine (not shown) is controlled to knit the panel 14 in conventional manner, as for example, one and one rib, two and one rib, three and one rib, or any other desired rib. Knitting the front panel 14 continues in the usual manner up to the bottom 18 of the knit-in pocket 12, by knitting a first portion of single layer thickness from the bottom margin of the garment panel to the pocket bottom 14 to define a first height. At the bottom 18 of the knit-in pocket 12, the machine continues to knit a second portion of the panel area of single layer thickness to knit a single panel construction 20 employing the desired rib stitch configuration to a second height which is equal to the desired height of the pocket as defined by the pocket top 44.

At each pocket location, a predetermined number of needles, for example, 50, as determined by the width of the pocket 12, are selected at the pocket location or locations of the garment 10 being fabricated and the number of which may be varied to fit either wider or narrower pocket configurations. The 50 needles (for example) selected for knitting the pocket construction, either high butt or low butt, depending on the machine being utilized, are arranged in well known manner to knit a tubular jersey pattern which includes the pocket rear panel 22. The rear panel 22 connects to the single panel construction 20 at the sides, top and bottom of the pocket to define a tubular enclosure. On a flat bed machine, this would mean knitting both the front bed and the back bed in the area defining the top 24, the bottom 18 and sides 26, 28 of the knit-in pocket 12. If desired, the front panel 30 of the tubular knit-in pocket 12 can be knit to conform in color to the remainder of the single panel construction 20 (FIG. 7), or can be knit to distinguish the pocket 12 from the remainder of the single panel construction 20 (see FIG. 5 and FIG. 6), depending on the desired finished appearance of the knit garment 10. The pocket rear panel 22 may be knitted jersey or other stitch on the rear bed to define an open pocket area 32 between the pocket front panel 30 and the pocket rear panel 22.

The front and rear layers of the knit-in pocket 12 each comprise half as many stitches as those in the sweater panel 14. The surrounding fabric portions 14 are constantly being knit on every other needle alternately on both cylinder and dial while the pocket or tubular portion 12 is being knitted in a jersey stitch. The front portion 30 of the pocket 12 is knit with all cylinder needles first in, for clarification purposes, section 1. The next course, section 2, knits the rear portion for panel 22 of the pocket 12 utilizing all dial needles only in a jersey stitch. Section 3 repeats the operation of section 1 and section 4 repeats the operation of section 2, etc. In short, a double bed flat or circular machine is required to knit the pocket 12. For example, a 12 feed TJI circular machine is suitable for the purpose. It is noteworthy that when the last course on top of the tubular pocket 12 is severed at the front top side only, the rear top portion of the tubular pocket remains intact without unraveling and the fabric above the pocket is knit the same as on both sides of the pocket. It will be appreciated that various stitch formations can be knit above the pocket in a manner well known to those skilled in the art.

In fabricating the kint-in pocket 12 on a circular knitting machine, for example a 12 feed TJI circular knitting machine, the dial and cylinder employ a high and low butt needle set-up and in a preferred embodiment, the cylinder needles can be controlled by Jacquard cards. In knitting the front panel 14, all needles, both cylinder and dial are employed for knitting the panel fabric. In accordance with procedures well known to those skilled in the art, there are numerous knitting set ups which could be employed to knit a panel 14 with the tubular pocket 12 formed therein. In the 12 feed TJI circular knitting machine which is employed for purposes of illustration, the panel 14 is formed by alternately knitting on all needles, both cylinder and dial in section 1. In section 2, the machine would be programmed to knit all dial needles only. In section 3, all needles, both cylinder and dial are knit and in section 4, knit all cylinder needles only. The above knitting sequence would then be repeated on sections 5 through 8 and through sections 9 to 12. This procedure shows only one method of a knitting sequence to knit the front panel 14 of a garment 10, both prior to and after knitting the pocket 12.

When the panel fabric is knit to the bottom of the pocket 12, in section 1, all of the cylinder and dial needles are knit with the exception that in the pocket section, for example 50 needles, the cylinder needles are controlled by Jacquard cards to be out of action. In section 2, knit all dial needles and in the pocket section, namely, the 50 needle section, for example, the dial needles are programmed out of action and the cylinder needles are knit in the pocket section only. In section 3, knit all cylinder and dial needles. In the pocket section, the cylinder needles are out of action as controlled by the Jacquard cards. In section 4, the dial needles are out of action and the machine is programmed to knit all cylinder needles. The above sequences are repeated through sections 5 to 8 and 9 to 12.

When the tubular fabric of the pocket is fully knit by following the sequence of steps above set forth, the last front course is separated or severed to create an open top 44. The long knitted loops 34, 36 at each top corner of the pocket 14 are formed by eliminating the holes when punching the Jacquard cards for the two or three courses on the last needle of each corner prior to and including the last course. This holds the stitch on one needle of the last course in order to separate the said course after snipping the thread 42 through the loops 34, 36 to thereby create the open top 44 of the tubular pocket 12.

When the predetermined pocket height is reached, the knitting machine (not shown) employed for the purpose can be programmed in well known manner to knit a tusk stitch loop 34, 36 on each end at the top corners 38, 40 of the knit-in pockets 12 so that the top 24 of the pocket can be readily opened by first cutting at the loops 34, 36 and then pulling a thread 42 at the top 24 of the pocket. The removal of the thread 42 opens the top pocket course without cutting and resulting product is a double layer completely enclosed knit-in pocket 12 having a knitted front panel 30, an integral knitted rear panel 22 which define an open pocket area 32 therebetween. When the thread 42 is cut at the loops 34, 36 and is pulled to open the top of the pocket 24 between the right and left long knitted loops 36, 34, the interior pocket area 32 then communicates with the area in front of the front panel 14 of the knit garment 10 at the open top 44 of the knit pocket 12. A third portion of the panel area 14 of single layer thickness is then knit above the pocket 12 to the top margin of the panel in a manner similar to that hereinbefore described for knitting the first portion.

The resulting product is a knit tubular pocket 12 defined by the knit front panel 30 and the knit rear panel 22 and having a closed bottom 18, closed sides 26, 28 and an open top 44. The back panel 22 remains uncut where it joins the single panel construction 20 and accordingly, cannot unravel in view of the fact that it is continuously knitted. Because the knitted loops at the top 24 of the front panel 30 remain uncut after the thread 42 is cut and pulled through one of the long knitted loops 34, 36, said top 24 of the pocket will not unravel after separation and can thereby be employed for pocket purposes without additional stitching, reinforcing or other costly hand or automatic knitting or sewing operations. Of course, if it is desired to communicate the open pocket area 32 with the interior side 46 of the front panel 14, the top of the pocket rear panel 22 should be opened in the manner hereinbefore set forth so that the front panel 30 of the pocket forms a complete continuation of the front panel 14 of the knit garment 10 without any openings.

Referring now to FIGS. 5, 6 and 7, I show methods whereby different style features can be created automatically and simultaneously with the formation of the knit-in pockets 12. For example, two, three or more colors to produce patterns or designs 48 can be knit in the front panel 50 of a patterned knit-in pocket 52. In conjunction with the pocket pattern 48, the sweater panel 54 can be knit with a complete solid color to thereby produce a garment having a unique appearance. Optionally, a sweater panel construction 56 can be knit with a float Jacquard design or other design and a plain pocket front panel 58 can be utilized to thereby produce a sweater having a completely different appearance while utilizing the method of the present invention. A top welt or band 68 may be conventionally applied to the pocket panel 58 if so desired. As illustrated in FIG. 7, both the sweater front panel 60 and the pocket front panel 62 can be designed with a single continuous pattern for example, stripes 64, to thereby blend the pocket construction 66 into the design of the sweater front panel 60. By following the teachings of the present invention, numerous designs, patterns, and color combinations can be automatically knit by utilizing conventional machines to provide a knitted garment having knit-in pockets 12 with an infinite number of design variation possibilities.

Figure 9:
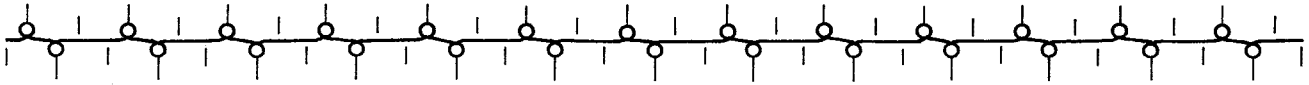
Figure 10:
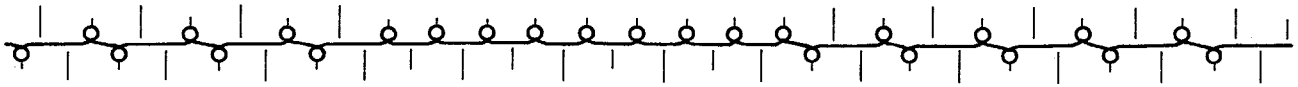

Referring now to FIGS. 8–15, FIGS. 8 and 9 show the knitting principle prior to knitting a tubular pocket by alternating the high and low butt cylinder and dial needles. FIG. 8 shows feeds 1, 3, 5, 7, 9 and 11 (low butt cylinder and dial needles). FIG. 9 shows feeds 2, 4, 6, 8, 10, 12 (high butt cylinder and dial needles). FIG. 10 illustrates the stitch formation at the start of the pocket 12. Low butt dial needles dial cam arrangement plus double butt dial needles are used. This is the first course of the pocket. The sides of the pocket are at the fabric 14 knitted in the manner illustrated in FIGS. 8 and 9.

Figure 11:
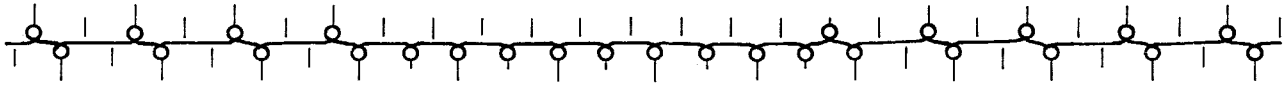
Figure 12:
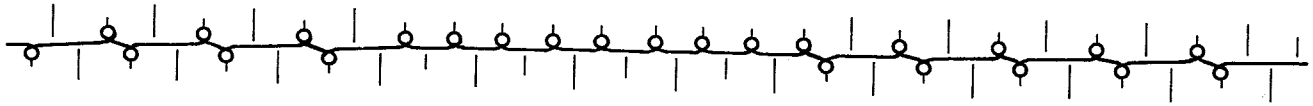

FIG. 11 shows the second course wherein all cylinder needles are used for the front side for panel 30 of the pocket 12 in a manner which creates a jersey stitch. These needles are controlled conventionally by Jacquard cards. The sides of the pocket comprise the knitted fabric 14 and are knitted as illustrated in FIGS. 8 and 9. The steps illustrated in FIGS. 10 and 11 are continuously knitted until the desired height of the pocket is obtained, (i.e., feed 1, 3, 5, 7, 9, 11 and 2, 4, 6, 8, 10, 12). FIG. 12 is the same as FIG. 10 and illustrates feeds 1, 3, 5, 7, 9, 11 during the knitting of the pocket.

Figure 13:
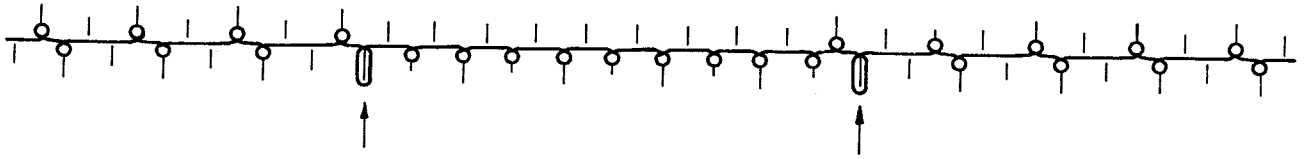
Figure 14:
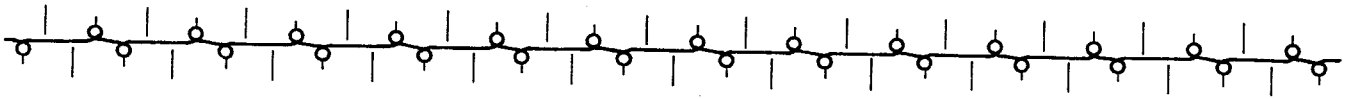
Figure 15:
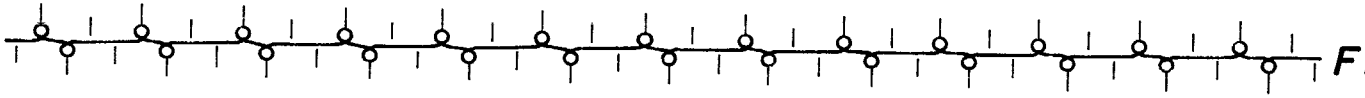

FIG. 13 illustrates the last cylinder course on the front side top of the pocket 12. This is the course that is separated either by pulling or cutting to create an opening in the front top portion of the Jersey tubular pocket. The long loop or tucks 34, 36 are predetermined and controlled by Jacquard cards and act as guides to the upper right and left corners of the front side 30 of the pocket 12. These loops or tucks are severed first and then pulled or cut on the same course. The dial or rear portion of the rear pocket does not unravel due to the construction of the stitch and knitting is continued following the sequence of FIGS. 14 and 15. It will be noted that the sequence of FIGS. 14 and 16 is a repetition of the sequence of FIGS. 1 and 2 and consequently is a continuation of the knitting structure of the fabric 14 of the bottom and sides of the sweater or garment panel. The knitting principle of FIGS. 14 and 15 is continued until the desired length of garment is obtained.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. The method of automatically knitting a pocket intermediate the top and bottom margins of a knitted garment having a panel area of single layer thickness, said pocket area having edges including a top, a bottom, a right side and a left side, including the steps of knitting from a yarn a first portion of the panel area of single layer, ribbed knitted fabric from one said margin to a first height defined by an edge of the pocket area;

knitting from the yarn a second portion of the panel area of single layer rib knit fabric from the first height to a second height defined by the top edge of the pocket area and simultaneously knitting the pocket area of tubular jersey knit, comprising a front pocket panel and a rear pocket panel;

joining the front and rear pocket panels to the second portion of the panel area at the top, bottom and sides thereof, said top comprising a top coursewise yarn thread;

knitting from the yarn a third portion of the panel area of single layer rib knit fabric from the second height to a third height defined by the second said margin;

knitting a long knitted yarn loop at the intersections of the pocket area top edge with each pocket panel side edge to expose a portion of the top coursewise yarn thread within the loop, cutting the top coursewise yarn thread at each loop and removing only that portion of the thread defined between the loops to separate the pocket top edge from the panel area.

2. The method of claim 1 and the additional step of separating only the top of the pocket front panel from the knitted fabric and leaving the top of the pocket rear panel connected to the knitted fabric.

3. The method of claim 1 and the additional step of employing a first color for the panel area and a second color only for the front pocket panel.

4. The method of claim 1 and the further step of knitting a float jacquard design only in the front pocket panel.

5. The knitted pocket produced by the method of claim 1.

6. The method of claim 1 and the additional step of separating only the top of the pocket front panel from the knitted fabric and leaving the top of the pocket rear panel connected to the knitted fabric.

* * * * *